United States Patent [19]

Durrer

[11] 3,971,302

[45] July 27, 1976

[54] CHIMNEY FOR EXHAUST GAS HAVING AN ADJUSTABLE MEANS FOR THROTTLING A FLOW OF EXHAUST GAS

[75] Inventor: Hermann A. Durrer, Brutten, Switzerland

[73] Assignee: Sulzer Brothers Limited, Winterthur, Switzerland

[22] Filed: Nov. 19, 1974

[21] Appl. No.: 525,178

[30] Foreign Application Priority Data

Nov. 23, 1973 Switzerland ..... 16508/73

[52] U.S. Cl. ..... 98/60; 98/58; 98/84; 114/211; 239/546

[51] Int. Cl.[2] ..... B05B 15/04

[58] Field of Search ..... 98/59, 85, 58, 60, 84; 114/187, 211, 212; 138/40, 44, 45, 109, 178; 239/546

[56] References Cited

UNITED STATES PATENTS

| | | | |
|---|---|---|---|
| 1,090,389 | 3/1914 | French | 98/59 |
| 1,322,711 | 11/1919 | Maranville | 98/85 |
| 1,327,452 | 1/1920 | Williams | 239/546 X |
| 2,593,420 | 4/1952 | Diehl | 239/546 X |
| 2,699,647 | 1/1955 | Goebel | 138/45 X |
| 2,714,847 | 8/1955 | Suebel | 98/58 |

FOREIGN PATENTS OR APPLICATIONS

| | | | |
|---|---|---|---|
| 672,807 | 2/1939 | Germany | 98/59 |

OTHER PUBLICATIONS

Acker, H. G., *Stack Design to Avoid Smoke Nuisance*, Bethlehem Steel Co., Mass., 1951, p. 33.

*Primary Examiner*—William F. O'Dea
*Assistant Examiner*—Harold Joyce
*Attorney, Agent, or Firm*—Kenyon & Kenyon Reilly Carr & Chapin

[57] ABSTRACT

The upper end of the chimney supports a throttling means formed by a pair of pivotally mounted parts which pivot towards each other to form a funnel. The two parts are located within an oval-shaped cover about the upper end of the chimney and are moved by means of a pulley system mounted on the chimney exterior.

11 Claims, 4 Drawing Figures

CHIMNEY FOR EXHAUST GAS HAVING AN ADJUSTABLE MEANS FOR THROTTLING A FLOW OF EXHAUST GAS

This invention relates to a chimney for exhaust gas with an adjustable means for throttling the flow of exhaust gas.

In order to protect a surrounding environment, the use of remote heating plants is of increasing significance and particularly the use of large-output plants because these plants can better control both the storage and the combustion of fuel than smaller heating, plants which serve small groups of buildings. However, such remote central heating plants have to be enlarged in the course of time because the territory served increases. The range of performance of a plant moreover varies through a year so that the plant operates with a lower performance in summer than in winter. Thus, the quantities of exhaust or waste gas from a central heating plant vary in an annual rhythm, as well as in the course of a number of years. If for architectural or economic reasons a central heating plant is provided with only a single exhaust gas chimney, which is dimensioned with a view to later enlargements for the then maximum load, a problem exists in that, particularly during summer operation, the exhaust gas emerges out of the chimney at a very low speed. In unfavorable weather, this can lead to considerable local emissions.

In order to eliminate this problem, it has been known to dispose a rectangular throttling flap in the region of the outlet from the chimney. Such flaps, however, have the drawback that the outlet cross-section is angular. Consequently, the flow of exhaust gas becomes disturbed in the edge zones. This, in turn, leads to a decrease of the dynamic superelevation of the gas.

Accordingly, it is an object of the invention to improve an exhaust-gas chimney of the aforesaid kind in such a way that the flow of exhaust gas in the open and closed settings of the throttling means leaves the chimney outlet through a round cross-section.

It is another object of the inventon to provide an exhaust gas chimney with a throttling means of relatively simple construction.

Briefly, the invention provides an exhaust gas chimney having an outlet end, and a throttling means at the end for throttling a flow of exhaust gas passing from the chimney end. The throttling means includes a pair of members which are movably mounted at the outlet end for movement between a closed position relative to each other to define an upwardly converging funnel-like nozzle above the outlet end for throttling a flow of gas passing from the outlet end and an open position out of the vertical plane of the outlet end.

This construction of the throttling means ensures that, in the limit positions of the two members forming the funnel-like nozzle, the flow of exhaust gas leaves the chimney outlet with a round cross-section. Moreover, the construction is very simple, and does not need maintenance. The construction and also the operation of the chimney, thus, does not entail any high cost.

In one embodiment, the plane of movement of the two members of the funnel-like nozzle is vertical to coincide with the most frequent wind direction. Generally, an inherent danger exists in the wind direction that the plume of exhaust gas may become disturbed by eddying detachment at the top of the chimney. However, because the plane of movement of the two members coincides with the most frequent wind direction the contour of the chimney-top exposed to the wind is decreased, the eddy-caused detachments are substantially reduced, and thus a pulling-down of the exhaust-gas plume is avoided.

A similar result occurs when a sheet-metal covering of oval contour in plan view is disposed in the region of the chimney top to receive the two members of the funnel-like nozzle in the open position. In this case, the major axis of the oval contour is situated in the most frequently occurring wind direction.

These and other objects and advantages of the invention will become more apparent from the following detailed description and appended claims taken in conjunction with the accompanying drawings in which:

Figures 1, 3:
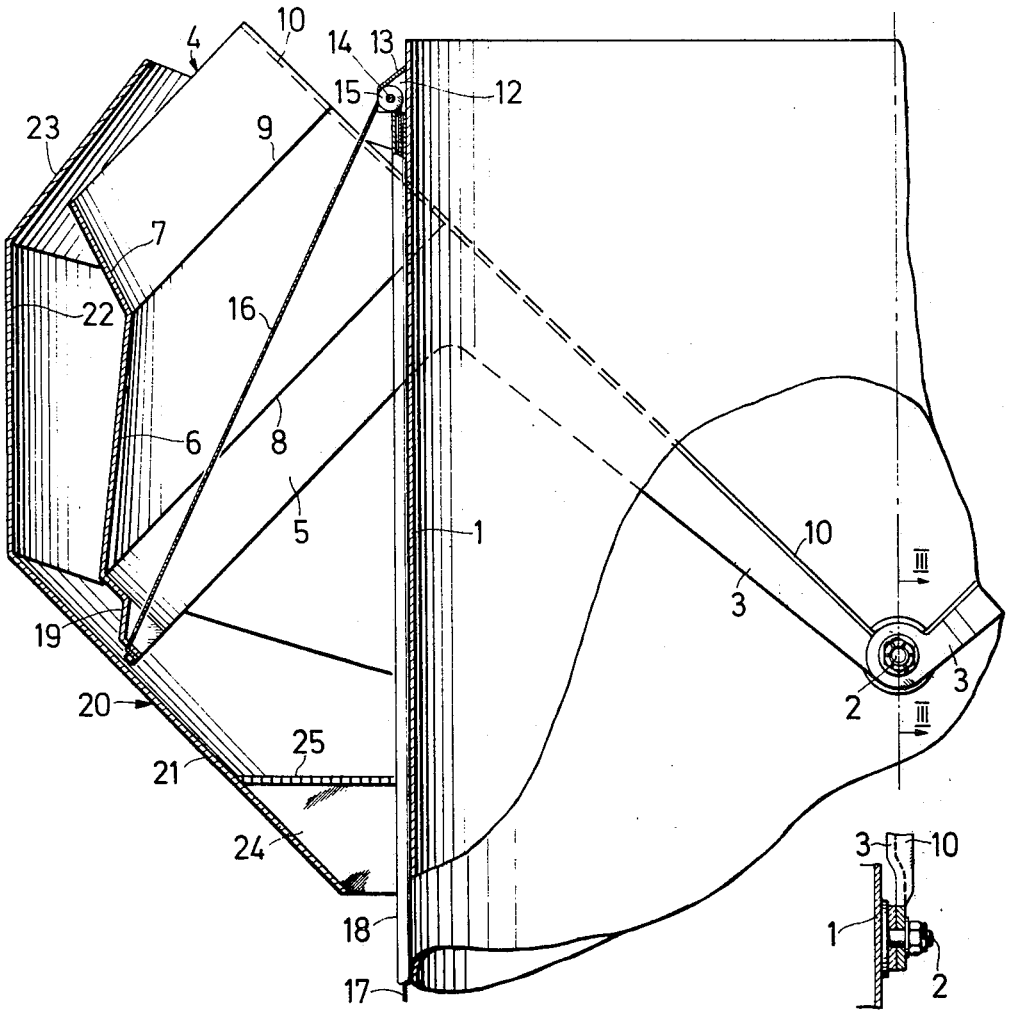
FIG. 1 illustrates a part of the top of a chimney according to the invention partly in vertical section and partly in a view.
FIG. 3 illustrates a view taken on line III-III of FIG. 1.

Referring to FIG. 1, the chimney consists of a vertical circular-cylindrical sheet-metal tube 1 to which two bolts 2 are fastened diametrically opposite to one another at an upper outlet end. In addition, a throttling means is mounted at the outlet end of the chimney. This throttling means includes a pair of members 4 of approximately the same shape each of which has two arms 3. As shown, the respective arms 3 are mounted on the bolts 2 to pivot the members 4 on the chimney. The two members 4 are movable between a closed position in which the members 4 define a funnel-like nozzle with a circular outlet opening perpendicular to the axis of the chimney (FIG. 4) and an open position (FIG. 1). In the Figures only one of the two members 4 is shown in each case, the other part being a mirror-image.

Each member 4 consists of a section 5 forming approximately half of a circular cylinder, a conical section 6 with a flat cone-angle, and a conical section 7 with an acute cone-angle. The three sections 5, 6, 7 are welded together along the two semicircular lines 8 and 9, and are stiffened at their ends in the dividing planes by radial webs 10. These webs 10 extend over the entire height of the member 4 starting from the upper edge of section 7 and continue in the adjoining arms 3.

Figure 4:
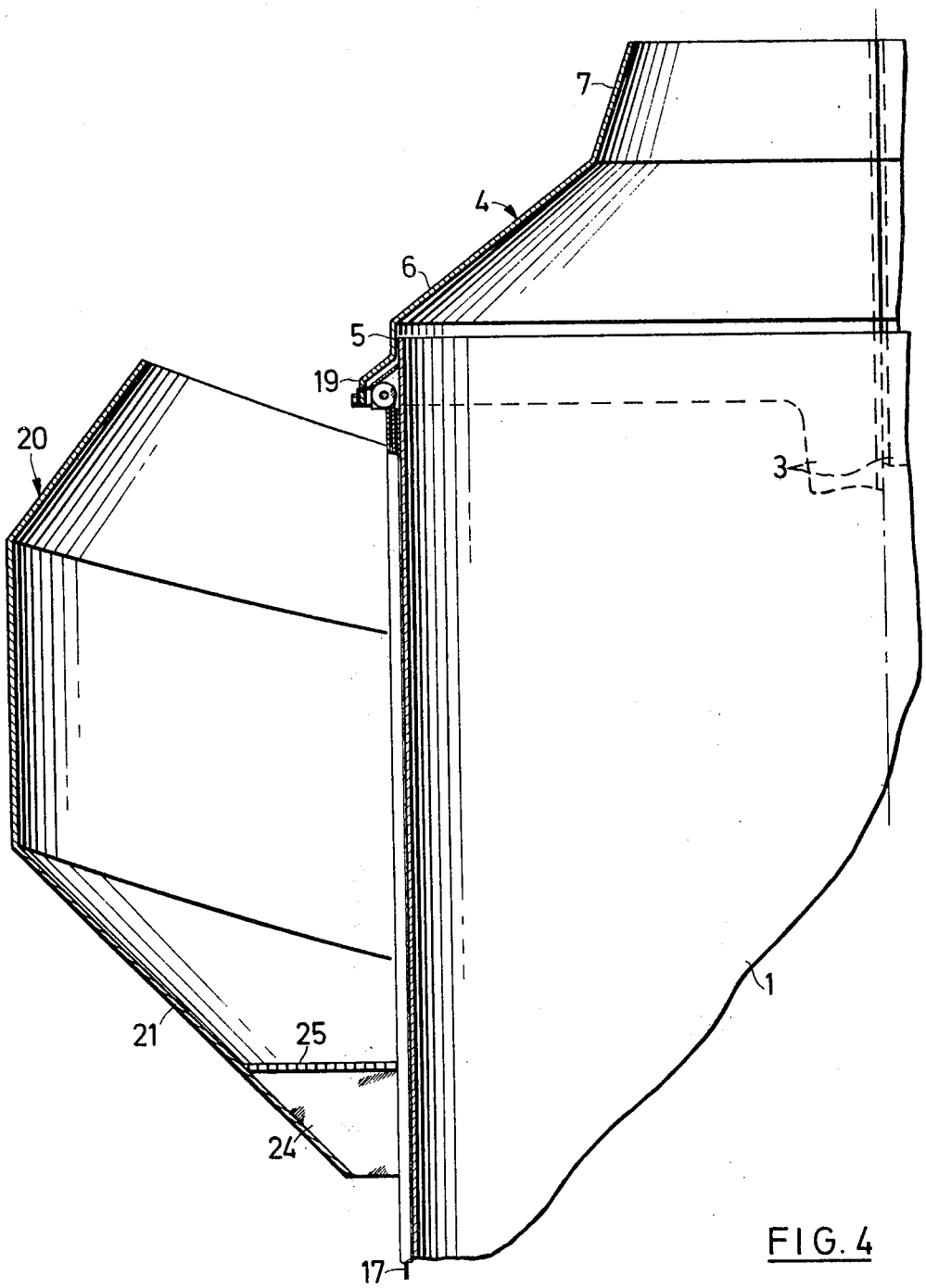
FIG. 4 illustrates a view corresponding to the vertical section of FIG. 1 with the throttling means of the invention shown in a position over the outlet opening of the chimney.

In order to move the members 4 toward and away from each other, a pulley system is provided. This system includes two parallel outwardly extending sheet-metal webs 12 which are welded on near the upper end of the chimney-tube 1. These webs 12 have upper edges connected together by a roof-like metal sheet 13 and mount a shaft 14. The shaft 14, in turn, carries a roller 15 provided with a peripheral groove to receive a wire cable 16. One end of the cable 16 is connected with a member 4. For this purpose, the section 5 of the member 4 is provided with a bulge 19, which is so large that in the closed position, the member 4 surrounds the roller 15 (FIG. 4). The chimney-side length 17 of the cable 16 is conducted, below the roller 15 into a vertical tube 18 fastened to the outside of the chimney-tube and is connected to a drive, which is for example provided on the ground.

Figure 2:
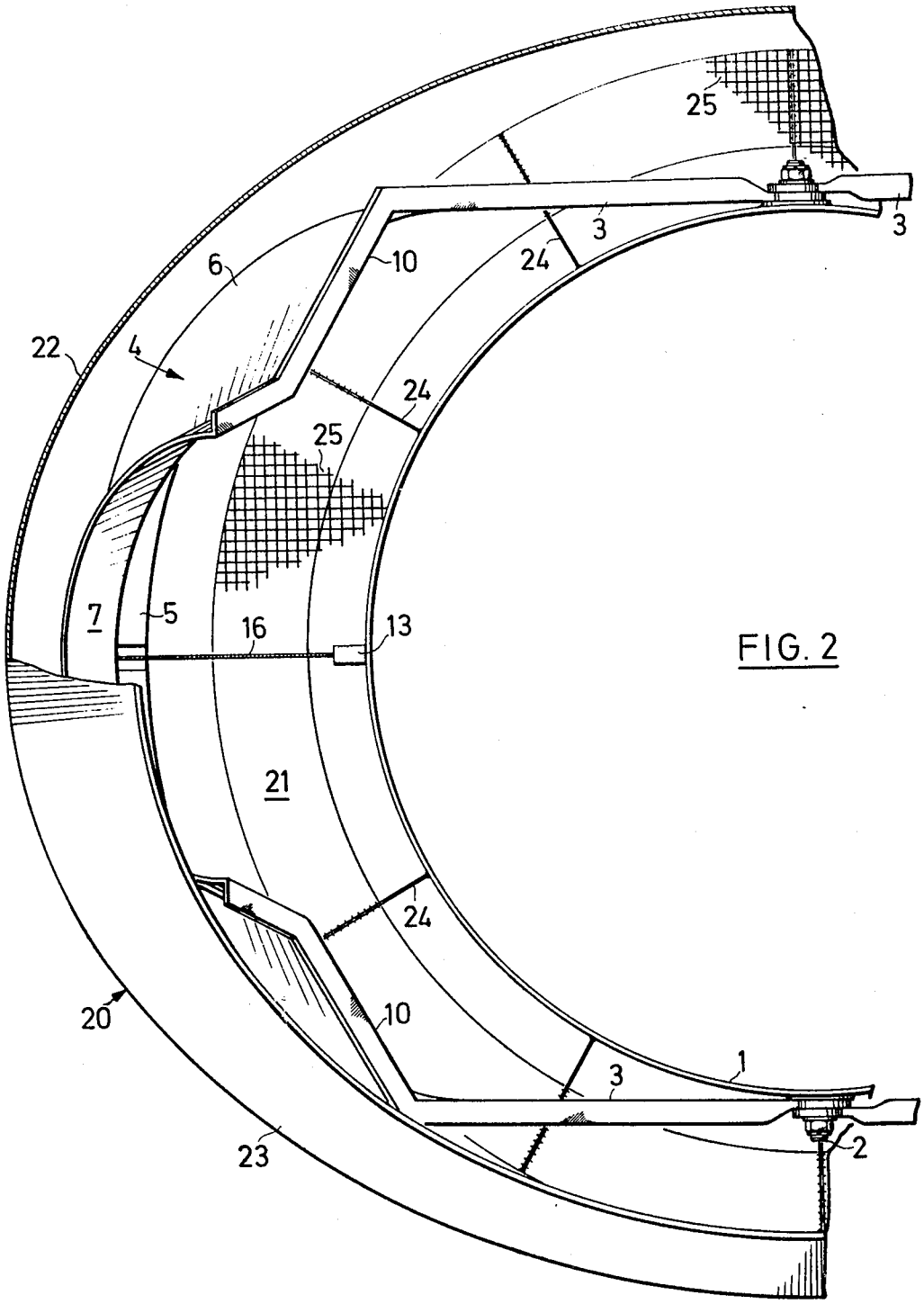
FIG. 2 illustrates a plan view of the upper end of the chimney of FIG. 1.

The upper end of the chimney is surrounded by a sheet-metal covering 20, which is oval in plan view (FIG. 2). This covering or shell 20 is composed of three sections, of which the lower section 21 and the upper section 23 are conical, and the middle section 22 is cylindrical. The entire covering 20 is fastened by a number of sheet-metal supports 24 to the chimney-tube. These supports 24 are welded on between the chimney-tube and the lower end of the lower section 21. Horizontal lattices 25 rest on the upper edges of the supports 24 which together form a platform extending all round the chimney, e.g. for installing the members 4 and for checking such components as warning lamps for air traffic, installed on the chimney.

The major axis of the oval formed in a plan view of the covering 20, is preferably set in that wind direction in which there is the greatest risk that the smoke plume leaving the chimney may be destroyed by turbulence at the top of the chimney. By means of this arrangement of the major axis of the oval, discontinuity phenomena are decreased and a pulling-down of the smoke plume is avoided.

The chimney has a ladder (not shown) for climbing. In addition, a section of the lattice 25 above the ladder and a door-like section of the covering 20 can be swung open to provide access to the inside of the covering 20.

By pulling on the lengths 17 of the two cables 16, the two members 4 can be brought in unison into the limit position shown in FIG. 4, in which the outlet opening from the chimney is reduced to a fraction. In that position, the boiler equipment (not shown) connected with the chimney can operate with minimum load. With increasing load, the two members 4 are moved away from one another, until at full load, the two members occupy the open limit position shown in FIG. 1.

Alternatively, it is also possible to move the two members of the funnel-like nozzle through rectilinear displacement above the outlet opening of the chimney. Also, it is possible for the chimney-tube to have a slightly tapered form so that the maximum diameter is situated at the bottom end of the tube.

What is claimed is:

1. An exhaust gas chimney having an outlet end and a throttling means at said end for throttling a flow of exhaust gas passing from said end, said throttling means including a pair of members movably mounted at said outlet end for movement between a closed position relative to each other to define an upwardly converging funnel-like nozzle above said outlet end for throttling a flow of gas passing from said outlet end and an open position relative to each other and out of the vertical plane of said outlet end.

2. An exhaust gas chimney as set forth in claim 1 wherein said members are pivotally mounted at said end of the chimney.

3. An exhaust gas chimney as set forth in claim 1 wherein said members are movable in a vertical plane coincident with the most frequent wind direction.

4. An exhaust gas chimney as set forth in claim 1 wherein each member includes two lateral arms and said chimney further has a pair of diametrically opposed bolts, each said bolt having a respective arm pivotally mounted thereon.

5. An exhaust gas chimney as set forth in claim 1 which further includes a pulley system for moving said members between said positions, said pulley system including a cable secured to each member.

6. An exhaust gas chimney as set forth in claim 5 wherein said system has a common drive connected to each cable.

7. An exhaust gas chimney as set forth in claim 1 which further includes a sheet metal covering having an oval contour in plan view mounted about said end for receiving said members in said open position thereof.

8. An exhaust gas chimney as set forth in claim 7 which further includes a horizontal platform within said covering.

9. An exhaust gas chimney having an outlet end and a throttling means at said end for throttling a flow of exhaust gas passing from said end, said throttling means including a pair of members movably mounted in unison at said outlet end for movement between a closed position relative to each other to define an upwardly converging funnel-like nozzle above said outlet end for throttling a flow of gas passing from said outlet end and an open position relative to each other and out of the vertical plane of said outlet end.

10. An exhaust gas chimney having an outlet end and a throttling means at said end for throttling a flow of exhaust gas passing from said end, said throttling means including a pair of members movably mounted at said outlet end for movement between a closed position relative to each other to define an upwardly converging funnel-like nozzle above said outlet end for throttling a flow of gas passing from said outlet end and an open position relative to each other and out of the vertical plane of said outlet end, said members defining a circular outlet opening in said closed position perpendicular to the axis of the chimney.

11. An exhaust gas chimney having an outlet end and a throttling means at said end for throttling a flow of exhaust gas passing from said end, said throttling means including a pair of members each being movably mounted at said outlet end for movement toward and away from the other between a closed position to define an upwardly converging funnel-like nozzle above said outlet end for throttling a flow of gas passing from said outlet end and an open position out of the vertical plane of said outlet end.

* * * * *